United States Patent [19]

Neumann

[11] 4,120,057

[45] Oct. 17, 1978

[54] ELECTROMECHANICAL ADJUSTING DEVICE

[75] Inventor: Gernot Neumann, Lippereihe, Fed. Rep. of Germany

[73] Assignee: Hanning Elektro-Werke Robert Hanning, Bielefeld, Fed. Rep. of Germany

[21] Appl. No.: 797,629

[22] Filed: May 17, 1977

[30] Foreign Application Priority Data

May 21, 1976 [DE] Fed. Rep. of Germany ..... 2622783

[51] Int. Cl.[2] ..... A47B 83/04; A61G 7/10; F16D 67/02

[52] U.S. Cl. ..... 5/66; 5/68; 74/421 A

[58] Field of Search ..... 5/66–68; 192/41 S; 64/28 R; 74/89.14, 421 A, 426

[56] References Cited

U.S. PATENT DOCUMENTS

| | | | |
|---|---|---|---|
| 2,500,742 | 3/1950 | Taylor | 5/69 |
| 3,635,461 | 1/1972 | Bellucci et al. | 5/66 |
| 3,716,876 | 2/1973 | Pitzon et al. | 5/68 |
| 3,921,230 | 11/1975 | Hanning et al. | 5/68 |

*Primary Examiner*—Casmir A. Nunberg
*Attorney, Agent, or Firm*—Emory L. Groff, Jr.

[57] ABSTRACT

An electromechanical adjusting device for pivotable head and/or foot parts of a bed frame with a pivot in the form of a rod movable with the pivotable part and extending transversely of the bed frame comprises a reversible rotary electric motor whose rotor shaft extends at right angles to the rod and drives a worm and worm gear and a pinion for driving the rod and itself driven by the worm and worm gear through spring clutch means, the adjusting device being supported by the rod.

7 Claims, 4 Drawing Figures

Fig. 3
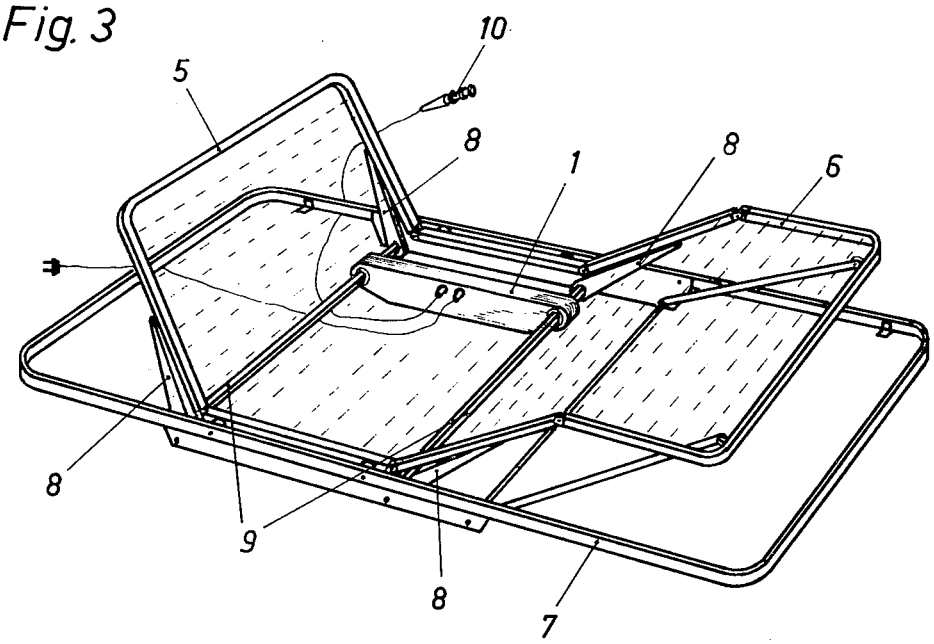
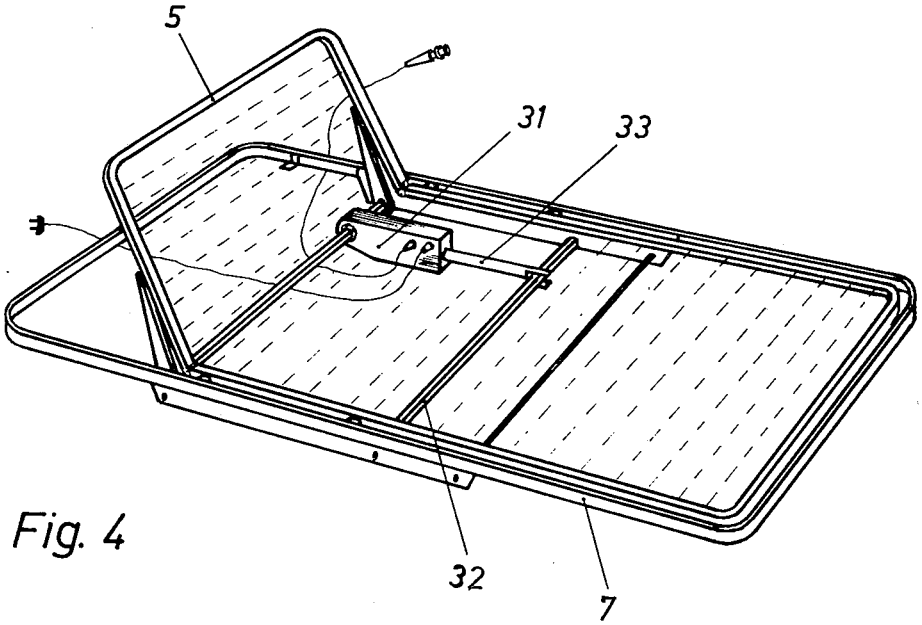
Fig. 4

ELECTROMECHANICAL ADJUSTING DEVICE

BACKGROUND OF THE INVENTION

The invention relates to an electromechanical adjusting device for the carrier frame of beds having a pivotable foot and/or head part on which actuating arms act, said arms being fixed to an adjustable shaft which is mounted crosswise to the plate carrier and which may be, for example, constructed as a square tube, the adjustable shaft carrying the adjusting device containing an electric motor arranged with its rotor shaft at right angles to the adjustable shaft in an insulating protective casing and supported at the other end on the carrier frame. Such devices are known from German Offenlegungsschrift No. 2,326,709 and British Patent Specification No. 1,044,500 in which linear servomotors are shown, the drive rod of which moves the adjustable shaft via a lever fixed thereto. This conversion of the linear motion into the rotary motion of the adjustable shaft with the aid of levers is also known from earlier hydraulic adjustable drives which may be seen for example, in British Patent Specification No. 855,112, but these are not suitable because of their fairly high susceptibiblity to faults.

When using drive levers acting on the adjustable shaft, it may be noted that, in a disadvantageous manner, the different angular positioning of the lever results in a different rotary moments to be exercised on the adjustable shaft. As a result of this, the power of the adjustable drive must always be matched to the most unfavourable conditions and this leads to a certain amount of overdimensioning of the drive. Furthermore, the levers as well as the remaining components becoming necessary represent additional outlay and makes assembly work more difficult and more expensive.

SUMMARY OF THE INVENTION

It is an object of the invention to provide an electromechanical adjusting device without the previously used drive levers. In addition, a design is to be achieved which provides pivot movement for the adjustable shaft of the foot or head part while economizing on other elements. As a result there is the possibility of managing with a drive of lesser power and of eliminating the faults connected with a lever drive. Furthermore, the outwardly completely enclosed device sought after by the invention in its preferred form provides the advantage that less dirt is able to collect and the device itself may be kept clean more easily than devices equipped with a lever mechanism. This point of view takes on considerable importance when installing the adjustable device in the carrier frame of beds, as a great deal of dust normally forms there. The latter point should be regarded as exceedingly important for reasons of hygiene above all with respect to application of the invention in the medical field.

According to the invention, there is provided an electromechanical adjusting device for pivotable head and/or foot parts of a bed frame with a pivot in the form of a rod movable with the pivotable part and extending transversely of said bed frame, said adjusting device comprising a reversable rotary electric motor, a rotor shaft for said shaft for said electric motor extending at right angles to said rod, a worm and worm gear driven by said rotor shaft, a pinion drivingly connected with said rod, spring clutch means between said worm and worm gear and said pinion and means for supporting said adjusting device on said rod.

BRIEF DESCRIPTION OF THE DRAWINGS

The invention will now be described in greater detail, by way of example, with reference to the drawings, in which:

FIG. 3 shows the perspective view of plate carrier equipped with the adjusting device from FIGS. 1 and 2, and FIG. 4 shows a plate carrier in perspective view having only one pivotable head part as well as an adjusting device matched thereto.

DESCRIPTION OF THE PREFERRED EMBODIMENT

Figure 1:
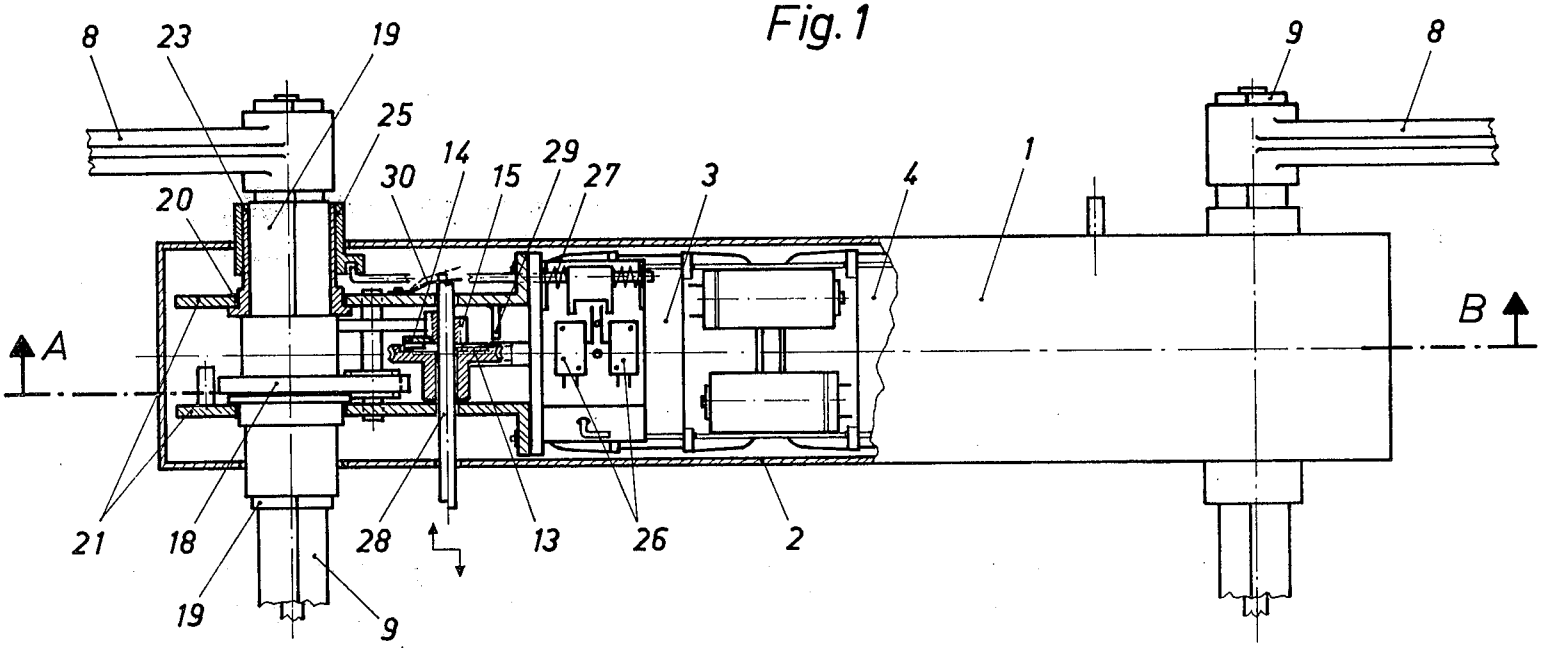
FIG. 1 shows a plan view partially in section of an electromechanical adjusting device formed in accordance with the invention for actuating the pivotable foot and head parts of plate carriers for beds.

In a preferred embodiment, the invention proposes an electromechanical adjusting device of the type stated at the outset in which the rotor shaft of a reversable electric motor is equipped with a drive worm with which a worm gear engages, said worm gear being in active connection with a pinion assigned to a clutch plate via the clutch plate forming a slip coupling therewith, and driving in turn a toothed segment limited in its movement by end stops by means of a reduction toothed gear pair. The toothed segment is set on the square sleeve which is mounted in the gear frame by interconnecting bearing bushes which may be rotated in bearing orifices of the side walls of a gear frame and which accommodates the adjustable shaft in a positive manner in its free inner area. In a further advisable refinement, a clamping ring provided with control tracks is arranged on a bearing bush of the square sleeve, its control tracks moving a longitudinally movable control rod which interrupts the supply of current of the electric motor in the final positions of the toothed segment respectively by means of actuating switches. This clamping ring provided with control tracks makes setting of the disconnection times of the debice possible when assembled without its protective casing having to be opened for this purpose.

A particularly advantageous constructional shape is provided if the worm gear, the clutch plate forming a slip coupling therewith, and its pinions have an axle which may be longitudinally displaced in the gear frame. This axle penetrates the worm gear which is unalterably mounted in its position so that said axle is freely movable and presses a spring element towards the worm gear at its end taken up by the clutch plate such that, in exceptional cases, the clutch plate held in engagement with the worm gear thereby may be disengaged from the worm gear by means of pressure exercised axially on the opposite end of the axle. As a result of this measure, the head or foot part may be lowered by hand at any time when there are faults in the device or when there is a current failure. The urgent need, in the case of beds for invalids, for raising the head part rapidly and jerkily when there is the danger of suffocation of a patient and for being able to release it thereby from the dangerous stretched out position of the back is taken into account by the slip coupling present in the device, this slip coupling preventing damage by crushing between the carrier frame and the pivotable foot or head part during its downward movement.

Finally, the newly developed adjusting device also offers the preconditions for being able to provide, as in mirror image, the devices housed in the protective casing, according to which one electric motor moves the head part and the other electric motor moves the foot part of the carrier frame while the two related square sleeves are placed on the adjustable shafts acting on the head part or the foot part while a further support against the plate carrier is eliminated. In this way there is the opportunity of developing the subject of the invention with the same construction elements as desired either as a single or double device.

Figure 2:
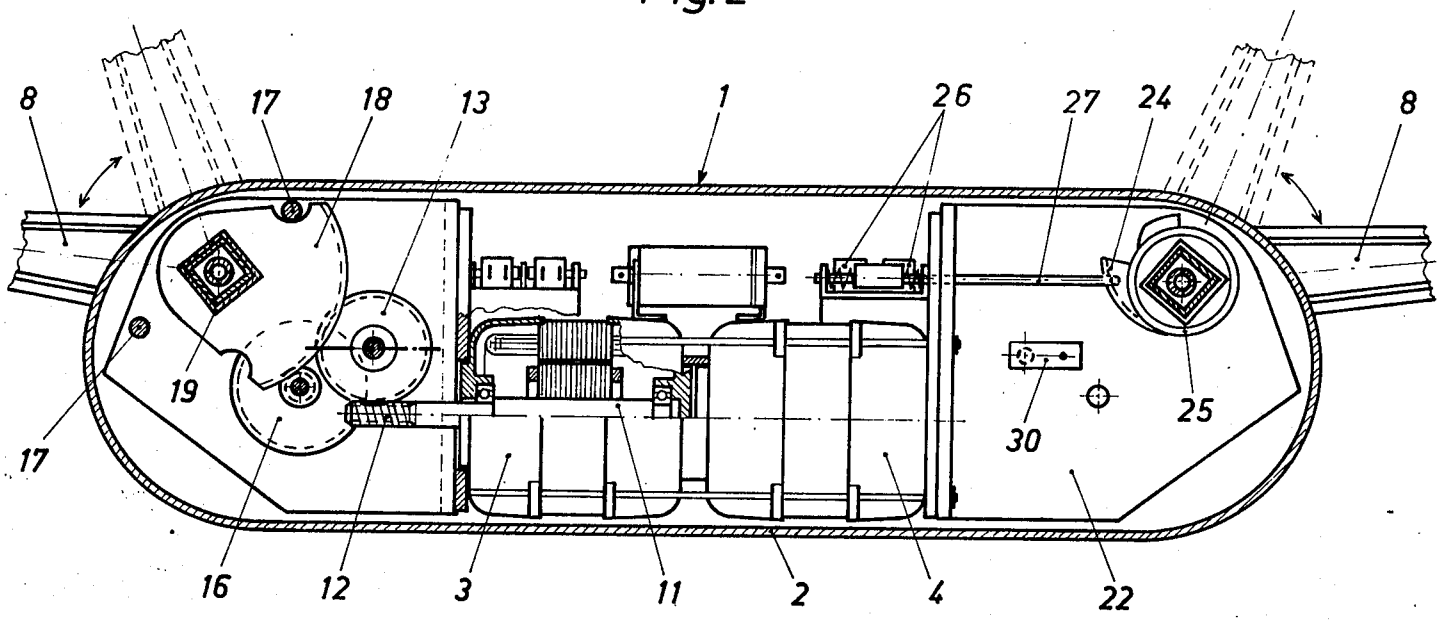
FIG. 2 shows the section view of the device from FIG. 1 in the region of the line A—B.

Referring now to the drawings, the adjusting device 1 shown in FIGS. 1 and 2 is housed in a protective casing 2 manufactured from insulating plastics. This contains two electric motors 3 and 4 arranged in mirror image manner which serve to move the pivotable head part 5 which may be seen from FIG. 3 and the foot part 6 of a carrier frame 7 for beds. Actuating arms 8, which are fixed to an adjustable shaft 9 mounted crosswise of the carrier frame 7 and constructed as a square tube, act both on the head part 5 as well as on the foot part 6 of the carrier frame 7. The adjusting device 1 is suspended from these adjustable shafts 9 below the carrier frame 7. Control thereof takes place by means of an air actuated switch 10 which eliminates contact with current-carrying parts of the circuit arrangement.

The rotor shafts 11 are equipped with a drive worm 12 for transmitting the rotary motions of the rotor shafts 11 of the electric motors 3/4, which are reversable, to the adjustable shafts 9 running at right angles to the electric motors 3/4. A worm gear 13 engages the drive worm 12, said worm gear being in active connection with a pinion 15 assigned to a clutch plate 14 via the clutch plate 14 forming a slip running coupling therewith. The latter drives a toothed segment 18, having limited movement limited by end stops 17, in turn by means of a reduction toothed gear pair 16, the toothed segment 18 being set on the square sleeve 19 accommodating the adjustable shaft 9 in positive manner in its free inner area, the square sleeve being mounted in the gear frame 22 by interconnecting bearing bushes 23 which may be rotated in bearing orifices 20 of the side walls 21 of a gear frame 22.

A clamp ring 25 provided with control tracks 24 is arranged on a bearing bush 23 respectively of the square sleeves 19. Its control tracks 24 actuate a longitudinally moved control rod 27 acting on electrical switches 26. The supply of current to the electric motor 3 or 4 is switched off by switches 26 if the toothed segment 16 is located in its end positions determined by the stops 17. This end disconnection of the electric motors 3 and 4 is accessible from outside by using the clamp rings 25 when the adjusting device 1 is in its assembled state, without its insulating protective casing 2 having to be opened for this.

The worm gear 13 in engagement with the drive worm 12 of the electric motor 3 or 4 respectively, the thrust plate 14 forming a slip coupling therewith and its pinions 15 are provided with an axle 28 which may be displaced longitudinally in the gear frame 22, said axle passing through the gear wheel 13 which is mounted unchangeably in its position by a stop 29, so that the axle is freely movable. A spring fixed to the gear frame 22 and pressing towards the worm gear 13 is located at its end taken up by the clutch plate 14. The said spring keeps the clutch plate 14 in engagement with the worm gear 13 by which the head part 5 or the foot part 6 may also be raised manually in the case of a fault or an emergency. Moreover, because of this measure, damage by crushing between the head part 5 or the foot part 6 and the plate carrier 7 is eliminated because the clutch plate 14 may slip in relation to the worm gear 13. In order that, in exceptional cases, the foot part 6 or head part 5 may be lowered independently of the drive, axial pressure must be exercised on the end of the longitudinally displaceable axle 28 which is opposite to the spring 30. It releases the clutch plate 14 from the worm gear 13 and thus causes separation of the adjustable shafts 9 from the electric motors 3/4 normally moving these adjustable shafts.

If according to FIG. 4 adjustment only of the head part 5 is envisaged then a single device 31 may be created by halving the adjusting device 1 which has been described and has two drive units operating independently of each other. Fastening it to diagonal trussing replacing the adjustable shaft 9 of the foot part 6 takes place by means of a support rod 33 while all remaining components of the adjusting device 1, apart from the protective casing 2, may be used unchanged for the device 31.

It will be understood that the above description of the present invention is susceptible to various modification changes and adaptions.

What is claimed is:

1. An electromechanical adjusting device for pivotable head and/or foot parts of a bed frame with a pivot in the form of a rod movable with the pivotable part and extending transversely of said bed frame, said adjusting device comprising a reversable rotary electric motor, a reduction gear for said electric motor, free wheeling spring clutch means in said reduction gear arranged to allow slip motion of said rod in a direction to raise said pivotable part, an insulative protective casing for said adjusting device and means for supporting said adjusting device on said rod.

2. An adjusting device as defined in claim 1 wherein said reduction gear comprises a worm and worm gear driven by a shaft of said electric motor, a pinion drivingly connected to said rod and drivably connected to said worm and worm gear through said free wheeling spring clutch.

3. An adjusting device as defined in claim 2 and comprising a gear segment fixed for rotation with said rod, end stops for said gear segment and reducing gear means connecting said gear segment and said pinion.

4. An adjusting device as defined in claim 3, and comprising a gear frame a square section sleeve on which said gear segment is fixed for receiving said rod when of corresponding section and extending between bearing bushes rotatable in apertures in side walls of said gear frame.

5. An adjusting device as defined in claim 4 and comprising an axle for said worm gear, a clutch plate of said clutch means and said pinions, displaceable longitudinally of said gear frame with said clutch plate and said pinions leaving said worm gear fixed in its axial position and spring element pressed by said axle in the direction of said worm gear to press said clutch plate in engagement with said worm gear movement of said axle against the pressure of said spring disengaging said clutch plate from said worm gear.

6. An adjusting device as defined in claim 4, and comprising two sets of parts arranged in mirror image, including a first said elecric motor moving the head part, and a second said electric motor moving the foot part and two said square section sleeves acting on said corresponding section rods of the head part and the foot part respectively and forming the sole support for said adjusting device.

7. An electromechanical adjusting device for pivotable head and/or foot parts of a bed frame with a pivot in the form of a rod movable with the pivotable part and extending transversely of said bed frame, said adjusting device comprising a reversable rotary electric motor, a rotor shaft for said electric motor extending at right angles to said rod, a worm and worm gear driven by said rotor shaft, a pinion drivingly connected with said rod, spring clutch means between said worm and worm gear and said pinion, means for supporting said adjusting device on said rod, a gear segment fixed for rotation with said rod, end stops for said gear segment, reducing gear means connecting said gear segment and said pinion, a gear frame, bearing bushes rotatable in apertures in side walls of said gear frame, a square section sleeve on which said gear segment is fixed for receiving said rod when of corresponding section and extending between said bearing bushes, an insulative protective casing for said adjusting device, a clamp ring arranged on one of said bearing bushes of said square section sleeve and control tracks on said clamping ring, a longitudinally movable control rod moved by said control tracks and switches actuated by said control rod for interrupting the supply of current to said electric motor in said end positions of said toothed segment.

* * * * *